US008216449B2

(12) United States Patent
Gleeson et al.

(10) Patent No.: US 8,216,449 B2
(45) Date of Patent: Jul. 10, 2012

(54) BUBBLE SEPARATION TO REMOVE HAZE AND IMPROVE FILTERABILITY OF LUBE BASE STOCKS

(75) Inventors: James William Gleeson, Burke, VA (US); Charles Lambert Baker, Jr., Thomton, PA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 451 days.

(21) Appl. No.: 12/381,802

(22) Filed: Mar. 17, 2009

(65) Prior Publication Data

US 2010/0236990 A1 Sep. 23, 2010

(51) Int. Cl.
*C10G 31/00* (2006.01)

(52) U.S. Cl. ..... 208/177

(58) Field of Classification Search ..... 208/177
See application file for complete search history.

(56) References Cited

U.S. PATENT DOCUMENTS

| | | | | |
|---|---|---|---|---|
| 2,719,817 | A * | 10/1955 | Doorn | 208/30 |
| 2,847,356 | A * | 8/1958 | Pieters et al. | 208/30 |
| 3,338,816 | A | 8/1967 | Tritsmans | |
| 3,347,775 | A * | 10/1967 | Tritsmans | 208/28 |
| 6,579,441 | B1 * | 6/2003 | Biscardi et al. | 208/28 |

* cited by examiner

*Primary Examiner* — Randy Boyer
(74) *Attorney, Agent, or Firm* — Robert A Migliorini

(57) ABSTRACT

Provided is a bubble generating process used to treat dewaxed lube base stocks to improve their filterability, hazy appearance or both. In one form, the process for improving at least one of haze appearance and filterability of a dewaxed lubricating oil basestock contained in a storage vessel includes contacting the lubricating oil basestock with gas bubbles passed through a gas distribution grid for a time sufficient to form a mixture of froth and gas treated basestock, allowing the mixture of froth and gas treated basestock to settle for a time sufficient to form a froth layer and a gas treated basestock layer, and separating the froth layer from the gas treated basestock layer, wherein a basestock having improved haze, improved filterability or both may be isolated from the gas treated basestock layer.

10 Claims, 2 Drawing Sheets

BUBBLE SEPARATION TO REMOVE HAZE AND IMPROVE FILTERABILITY OF LUBE BASE STOCKS

FIELD

This disclosure relates to a bubble generating process used to treat dewaxed lube base stocks to improve their filterability, hazy appearance or both. The process uses the production of gas bubbles in the lube stock to improve at least one of filterability or haze.

BACKGROUND

Flotation is a common method for separating mixtures. It is commonly employed in the mining field to separate solids. The minerals such as ores or coal are pulverized and then subjected to separation methods such as froth flotation. The fine particles are mixed with water to form a slurry and air is bubbled through the slurry to produce a froth which typically contains the desired mineral while the remainder of the slurry contains the unwanted materials. Chemical additives such as surfactants may be added to improve the separation. The froth may then be dewatered by filtration or gravity separation. Flotation techniques are also widely employed in paper production and water treatment. In industrial waste water treatment, fats and oils are separated from water using treatment units such as dissolved air flotation (DAF) units.

Haze formation in lubricant oil base stocks is typically associated with molecules having some paraffinic characteristics, e.g., waxy molecules and molecules having long paraffinic chains. Lubricant oil base stocks are conventionally prepared by various combinations of hydrotreating, hydrocracking, solvent extraction, solvent deasphalting, solvent dewaxing, catalytic dewaxing, and hydrofinishing. Waxy molecules in the lubricant oil feed stock may be at least partially removed by solvent dewaxing or catalytic dewaxing. Solvent dewaxing typically involves mixing with solvents, usually at atmospheric pressure, separating wax that precipitates, and recycling recovered solvent. The solvent is usually chilled prior to addition to the dewaxing solvent, usually in a cooling tower. Representative solvents include aliphatic ketones, low molecular weight hydrocarbons and mixtures with aromatic solvents such as benzene, toluene or xylene.

Catalytic dewaxing involves contacting the feed to be dewaxed with a dewaxing catalyst under dewaxing conditions. Dewaxing catalysts usually function primarily by cracking or primarily by isomerization. Cracking dewaxing catalysts remove waxes by cracking them to molecules having lower molecular weights. Some yield loss occurs while using cracking dewaxing catalysts as such catalysts normally involve some cracking to molecules outside the lubricating oil range. ZSM-5 is an example of a dewaxing catalyst that normally functions primarily by cracking. Catalysts which function primarily by isomerization, e.g., ZSM-48, isomerize the paraffinic waxy molecules to more highly branched molecules. These isomerized molecules generally have more favorable properties with regard to viscosity and pour points.

Regardless of how dewaxing is accomplished, it is typical to follow dewaxing with a further step to remove small amounts of color bodies or haze forming bodies that remain after or are formed during dewaxing. Haze forming precursors result in haze typically upon standing. Haze is more of a problem at lower temperatures. These haze forming precursors generally have waxy character but are not necessarily simple long-chain molecules associated with wax. Such precursors may include cyclic and heterocyclic moieties to which are attached side chains having waxy paraffin character. Haze precursors can be removed by hydrofinishing. Hydrofinishing is a catalytic process and may be considered as a form of mild hydrotreating. Hydrofinishing may involve the same catalysts that are used in hydrotreating although at generally lower temperatures. Hydrofinishing may also be accomplished using the M41S family of mesoporous catalysts such as MCM-41, MCM-48 and MCM-50. U.S. Pat. No. 6,579,441 describes a process for dehazing a base oil using solid adsorbents to remove at least a portion of the haze precursors.

Haze precursors may also result from dewaxing that is not and/or cannot practically be carried out to the extent necessary to prevent haze formation. For example, leaks in solvent dewaxing filter cloths and bypassing in beds of catalysts used to dewax lubricant base stocks are inevitable and are usually difficult to detect. Leaks of much less than 1% can cause haze formation in the resulting lubricant base stock. Haze may also be caused by small inorganic particulates, such as from catalyst fines or corrosion.

There is a need to improve the filterability, haze formation or both of lubricating oil basestocks without the need for catalysts or adsorbents.

SUMMARY

Provided herein are processes for improving all numerical values in this disclosure are understood as being modified by "about" or "approximately" the indicated value, and take into account experimental error and variations that would be expected by a person having ordinary skill in the art.

In one embodiment, the present disclosure relates to a process for improving at least one of haze appearance and filterability of a dewaxed lubricating oil basestock contained in a storage vessel which comprises: contacting the lubricating oil basestock with gas bubbles passed through a gas distribution grid for a time sufficient to form a mixture of froth and gas treated basestock, allowing the mixture of froth and gas treated basestock to settle for a time sufficient to form a froth layer and a gas treated basestock layer, and separating the froth layer from the gas treated basestock layer wherein a basestock product having improved haze, improved filterability or both may be removed from the gas treated basestock layer.

In another embodiment, the present disclosure relates to a continuous process for improving at least one of haze appearance and filterability of a dewaxed lubricating oil basestock comprising: conducting the dewaxed lubricating oil basestock to a process vessel, contacting the basestock with gas bubbles passed through a gas distribution grid for a time sufficient to form a foam layer and a gas treated basestock layer, conducting overflow from the foam layer to a defoamer and removing a gas treated product from the gas treated basestock layer, wherein the product removed has improved haze appearance, improved filterability or both.

In yet another embodiment, the product removed from either the storage vessel or the continuous process has at least one of improved haze to pass the clear and bright test of ASTM D-4176-93 or improved filterability by at least 50%.

BRIEF DESCRIPTION OF THE DRAWINGS

To assist those of ordinary skill in the relevant art in making and using the subject matter hereof, reference is made to the appended drawings, wherein.

DETAILED DESCRIPTION

Provided herein are bubble generating processes used to treat dewaxed lube base stocks to improve their filterability, hazy appearance or both. All numerical values in this disclosure are understood as being modified by "about" or "approximately" the indicated value, and take into account experimental error and variations that would be expected by a person having ordinary skill in the art.

Feedstock

The feedstocks to be treated by the present bubble process are lubricating oil basestocks that have been dewaxed. The present lubricating oil base stocks have an initial boiling point range of at least 370° C. The base stocks are not dependent on source and may be derived from petroleum oil, petroleum wax, synthetic oil, or Fischer-Tropsch wax. The base stocks may have been treated by different manufacturing processes including distillation, solvent refining including solvent extraction and deasphalting, hydrocracking, hydrotreating, solvent dewaxing, catalytic dewaxing and hydrofinishing. Fischer-Tropsch waxes are derived from synthesis gas using the well-known Fischer-Tropsch reaction.

A common feature of the lubricant base stocks to be treated with bubble separation according to the disclosure is that the base stocks, regardless of manufacturing source, have been dewaxed so that the wax content of the base stocks is less than 0.1 wt %, based on dewaxed base stock, preferably less than 0.02 wt %. Dewaxing of basestocks, including those derived from petroleum sources or synthetic sources such as Fischer-Tropsch wax, is typically accomplished using at least one of catalytic dewaxing or solvent dewaxing under catalytic or solvent dewaxing conditions. Dewaxing is frequently preceded by at least one of hydrotreating or hydrocracking. Dewaxing catalysts are well-known in the art and include both cracking and isomerizing catalysts.

The wax content covers pour point and cloud point concerns, i.e., if the pour point were 50° C., the process would work differently. However no basestock of interest has a pour point that high.

A further feature of the present lubricant base stocks (oils) is that they contain little or no cracked oils, i.e. they contain less than 0.01 wt % based on oil, of cracked components. Cracked oils are those that have been cracked by thermal or catalytic treatment, and include such oils as cycle oils and coker oils, without subsequent hydrofinishing. Such cracked oils degrade the stability of the lubricating oil. The viscosity of the lube oil feedstocks can range up to 500 cSt or more.

Process Conditions

Figure 1:
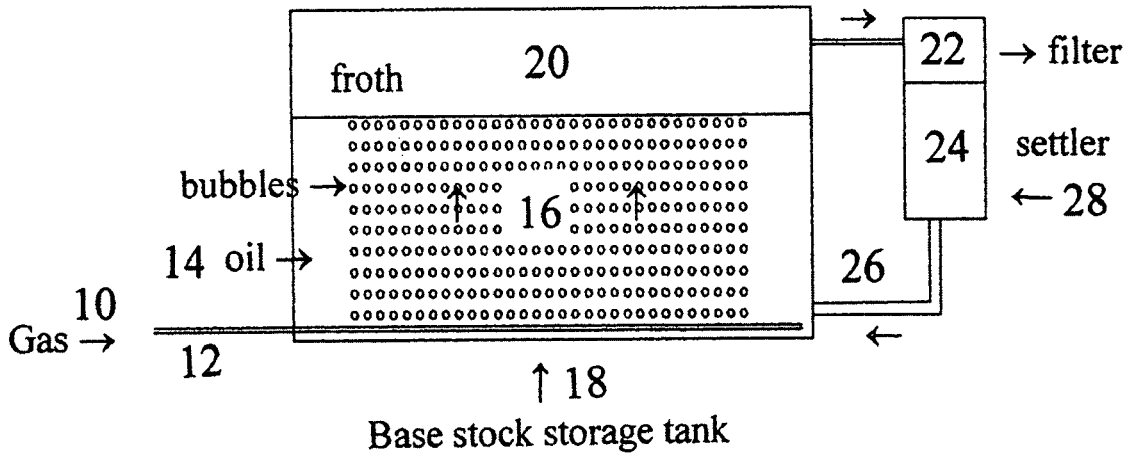
FIG. 1 is a schematic illustrating bubble generation in lube oil contained in a storage vessel.

In the present process, lubricating oil basestock is contacted with a source of gas bubbles. The gas bubbles may be generated by different methods. In one embodiment, the gas bubbles may be generated by injecting gas through small holes in pipes or through frits that are located in the lubricating oil basestock. This is illustrated in FIG. 1 which is a schematic illustrating bubble generation in lube oil contained in a storage vessel. As shown in FIG. 1, gas 10 is injected through pipes 12 located near the bottom of the storage tank 18, the pipes 12 containing a plurality of small holes. The bubbles 16 rise through the base oil 14 forming an upper froth (foam) 20. The upper froth or foam layer is conducted to a settler 28. A gas treated oil may be removed from the bottom of the basestock layer remaining in the storage vessel. In one embodiment, the lower layer 24 from the settler 28 may be returned to the storage tank through line 26 to be again contacted with bubbles. Alternatively, the upper layer 22 of settler contents may be conducted to a filtration apparatus (not shown) to remove any particulates. The oil layer from the settler, after filtration, can be sent for further processing.

Figure 2:
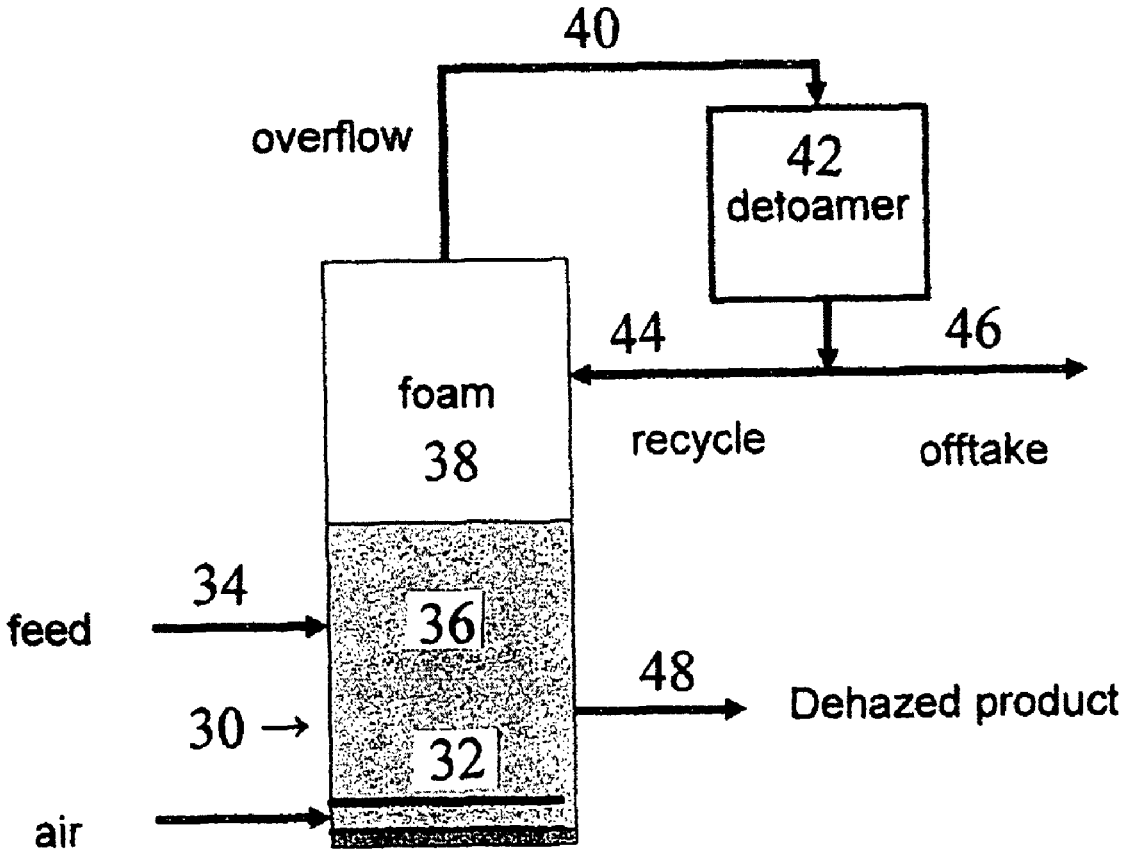
FIG. 2 is a schematic illustrating bubble generation in lube oil contained in a process vessel.

FIG. 2 is a schematic showing bubble generation in a continuous mode in a process vessel. Air is conducted to air distribution grid 32 in vessel 30. The grid generates gas bubbles through holes or frits in the distribution grid. The distribution grid may be a multiplicity of pipes containing small holes for gas generation. The feed is conducted into vessel 30 through line 34 forming feed (oil) layer 36. The feed is added to the oil layer at a point in close proximity to the gas distribution grid. Gas bubbles rise through layer 36 to form a foam layer 38. Overflow from foam layer 38 is conducted through line 40 to defoamer 42. Effluent from 42 may then be recycled through line 44 to foam layer 38. Alternatively, effluent from defoamer 42 may be removed as offtake 46. Dehazed product may be removed from the bottom of vessel 30 through line 48.

The lube oil to be gas treated need not be cooled. The lube oil temperatures may range from 0 to 80° C. The temperature will depend on the nature of the material to be removed. Maximum temperatures at which the haze will still be in the solid state but cool enough that the lubricating base oil does not degrade are advantageous. If the present process is operated in a batch mode, there is no need to inject fresh oil into the process. If there is a recycle stream, that recycle stream need not be cooled. This eliminates the need for heat exchangers to cool the recycle stream. The cloud point is not critical and the present process may operate above or below the cloud point. Since the lube oil feeds have already been dewaxed, the recycle rate need not be controlled to avoid wax deposition or injected toward the bottom of the floatation zone since it does not provide cooling for the process. Re-injecting the recycle stream near the top of the column is advantageous for separation efficiency. Since the lube oil feeds have already been dewaxed, a smaller waste stream is generated that must be disposed of. Nor is it necessary to add diluent oils to lower the viscosity as may be required to avoid wax deposition from wax in waxy feeds.

The gas to be injected may be any gas that will not oxidize components of the lube oil under gas injection conditions. Without being bound to any particular theory, it is believed that haze is caused by waxy particles that have limited solubility in the oil, not by reactions that degrade the oil. Preferred gases include air, provided that oxidation is not a problem, and nitrogen. Especially preferred is nitrogen. Other exemplary non-limiting gases that may be injected include hydrogen, argon, carbon dioxide, light hydrocarbons such as propane, or combinations of such gases.

The gas bubbles are generated by orifices in the gas distribution system within the vessel containing the lubricating base oils (stocks). It is preferred that the gas distribution grid is at or near the bottom of the base oil layer. Alternatively, the gas distribution grid may distribute the gas bubbles uniformly at different levels within the base oil. The preferred gas bubble generating system includes pipes containing orifices through which gas escapes to form bubbles. Other bubble generating systems include frits and gas dispersing impellers. The gas is injected into the gas distribution system under pressure sufficient to generate bubbles when passing through orifices. The precise minimum pressure required to generate gas bubbles will be dependent on the size of the orifice openings. Gas pressures in excess of the minimum pressure will increase the rate of bubble generation. Only pressures easily generated by commercial pumps are needed. Those pressures must exceed the sum of the capillary pressure of the orifice or frit saturated by the lubricating base oil (typically 1-10 psi) and the column head pressure (typically 1-20 psi).

Another embodiment for generating gas bubbles in the base oil is to dissolve gas in the base oil by pressurizing the base oil with gas and then lowering the pressure. This will cause the dissolved gas to separate from the base oil as small bubbles, thus creating the same effect as injecting gas through orifices in pipes. The pressure is that needed to dissolve gas into base oil at the temperature of the base oil. Once the base oil is saturated with gas, the pressure can be lowered to a lower pressure such as atmospheric pressure.

The oil column is preferably oriented vertically plumb to prevent channeling. Dehazing, that is, removing particulates of all sorts such that no haze of any sort is apparent in close examination by those skilled in the art of evaluating lubricating base stocks, is considered more demanding of process conditions than, e.g., dewaxing, due to the smaller size of the haze particles. The smaller size of the haze particles requires smaller bubbles and/or greater bubble density to dehaze in the same amount of time as to remove larger particles, all other conditions being the same. In addition, dehazing base stocks without cracked or polar or surface active materials that enhance the capture of particles by bubbles is more demanding than applications that contain those materials. We have found that a volumetric ratio of 0.1 to 10 lubricating oil to bubbling gas can be effective for dehazing. A ratio of 1 vol:1 vol lubricating oil to bubbling gas is preferred. We have also found that bubbles such as are generated with an ASTM D892 diffuser are effective for dehazing. Many of the bubbles generated are smaller than 1 mm. Much lower rates of bubbling, much larger bubbles, and bubbling carried out with a 3 inch column canted 5 degrees from vertical were observed to be less effective for dehazing.

The treating of base oil with gas bubbles may occur in either batch mode or continuous mode. The scheme set forth in FIG. 2 is an illustration of continuous mode operation. Any froth formed during gas treatment may be separated from oil using conventional separation techniques such as settling, coalescing, or degassing by evacuation. The treated oil (i.e., removed from the bottom of the column or vessel) should be particulate free.

The oil of the offtake (continuous mode) or top of the vessel (batch mode) can either be further concentrated by a subsequent stage of floatation, the haze separated from the remaining oil by a separate process, or used for another purpose. Both of the first two increase the yield and/or efficiency of the process.

An option in the process is to include an agent to help agglomerate the haze precursors. This can be done either by adding fine particles to the feed or cooling the feed to generate the optimum concentration of waxy particles to agglomerate the haze. The fines can later be removed from the froth by filtration or centrifugation. The additional wax formed by cooling can be remelted and recycled back to the process through the recycle stream or the feed.

While haze formation may not necessarily impact performance of the oil for lubricating purposes, it is nevertheless a perceptual problem that is normally addressed in commercial base oils. Haze can be measured by the "clear and bright" standard set forth in ASTM D-4176-93. Unlike many current means for controlling haze formation on standing, the present process does not utilize catalytic treatment nor are additives such as adsorbents required.

The following examples will illustrate the improved effectiveness of the bubble treatment of the present disclosure, but are not meant to limit the present disclosure in any fashion.

EXAMPLES

Example 1

This example is directed to showing improvement in a base stock having a hazy appearance and poor filterability. A heavy lubricant oil base stock derived from petroleum vacuum distillate bottoms and produced by propane deasphalting, solvent extraction, catalytic dewaxing using a ZSM-5 catalyst, and hydrofinishing was hazy and had poor filterability. Nitrogen gas was bubbled through 250 ml of sample in a 500 ml graduated cylinder for 6 hours at 38° C. (100° F.) using an ASTM D892 foam diffuser. Once during the process, the froth overflowed. At the end of the treatment, the sample was cooled overnight. Then the top 50 ml of the sample was removed and the bottom portion of the sample remaining in the graduated cylinder was examined for appearance and filterability. Table 1 below shows that both filterability and haze appearance were improved by the bubble treatment.

TABLE 1

| | Initial | After Bubble Separation |
|---|---|---|
| Appearance | hazy | clear and bright |
| Filtration time, sec* | >1800 | 151 |

*The filtration time is the time to completely pass a mixture of 75 ml of the sample lube oil and 25 ml of a naphtha through a 5.0 micron filter membrane at 23° C. under vacuum.

Example 2

This example shows improvement in filterability for a sample with acceptable haze appearance. Another heavy lubricant oil base stock derived from petroleum vacuum distillate bottoms produced by propane deasphalting, solvent extraction, catalytic dewaxing, and hydrofinishing had poor filterability. Nitrogen gas was bubbled through 250 ml of sample in a 500 ml graduated cylinder for 6 hours at 38° C. (100° F.) using an ASTM D892 foam diffuser. At the end of the treatment, the sample was cooled overnight. Then the top 50 ml of the sample was removed and the bottom portion of the sample remaining in the graduated cylinder was examined for filterability. Table 2 below shows that the filterability was improved by the bubble treatment.

TABLE 2

| | Initial | After Bubble Separation |
|---|---|---|
| Filtration time, sec | >1800 | 137 |

Applicants have attempted to disclose all embodiments and applications of the disclosed subject matter that could be reasonably foreseen. However, there may be unforeseeable, insubstantial modifications that remain as equivalents. While the present disclosure has been described in conjunction with specific, exemplary embodiments thereof, it is evident that many alterations, modifications, and variations will be apparent to those skilled in the art in light of the foregoing description without departing from the spirit or scope of the present disclosure. Accordingly, the present disclosure is intended to embrace all such alterations, modifications, and variations of the above detailed description.

All patents, test procedures, and other documents cited herein, including priority documents, are fully incorporated by reference to the extent such disclosure is not inconsistent with this disclosure and for all jurisdictions in which such incorporation is permitted.

When numerical lower limits and numerical upper limits are listed herein, ranges from any lower limit to any upper limit are contemplated.

What is claimed is:

1. A continuous process for improving at least one of haze appearance and filterability of a dewaxed lubricating oil basestock comprising:

conducting a dewaxed lubricating oil basestock to a process vessel, the dewaxed lubricating oil basestock having a wax content of less than 0.1 wt % based on dewaxed base stock, contacting the basestock with gas bubbles passed through a gas distribution grid at a temperature of at least 38° C. for a time sufficient to form a foam layer and a gas treated basestock layer, and conducting overflow from the foam layer to a defoamer and removing a gas treated product from the gas treated basestock layer, wherein the gas treated product removed has improved haze appearance, improved filterability or both.

2. The process of claim 1 wherein the product removed has at least one of improved haze to pass the clear and bright test of ASTM D-4176-93 or improved filterability by at least 50%.

3. The process of claim 1 wherein the wax content of the dewaxed lubricating oil basestock is less than 0.02 wt %, based on dewaxed base stock.

4. The process of claim 1 wherein the dewaxed lubricating oil basestock includes less than 0.01 wt % based on oil, of cracked components.

5. The process of claim 1 wherein gas used to form gas bubbles may be any gas that will not oxidize components of the lube oil under gas injection conditions.

6. The process of claim 5 wherein the gas is at least one of air or nitrogen, provided that dewaxed lubricating oil basestock does not include any component that may be oxidized by air.

7. The process of claim 1 wherein gas is injected into the gas distribution grid under pressure sufficient to generate bubbles when passing through orifices in the gas distribution grid.

8. The process of claim 1 wherein gas used to create gas bubbles is present in a volumetric ratio of 0.1 to 10 dewaxed lubricating oil basestock to gas bubbles.

9. The process of claim 1 wherein the gas distribution grid for generating gas bubbles is replaced by dissolving gas in the base oil by pressurizing the base oil with gas and then lowering the pressure.

10. The process of claim 1 wherein effluent from the defoamer is recycled to the foam layer in the process vessel.

* * * * *